US011352802B1

(12) United States Patent
Rush

(10) Patent No.: US 11,352,802 B1
(45) Date of Patent: Jun. 7, 2022

(54) APPARATUS AND METHOD FOR SUPPORTING AN ELEVATED FORM PANEL

(71) Applicant: Michael G. Rush, Sioux City, IA (US)

(72) Inventor: Michael G. Rush, Sioux City, IA (US)

( * ) Notice: Subject to any disclaimer, the term of this patent is extended or adjusted under 35 U.S.C. 154(b) by 246 days.

(21) Appl. No.: 16/681,937

(22) Filed: Nov. 13, 2019

(51) Int. Cl.
*E04G 21/18* (2006.01)
*E04G 11/00* (2006.01)
*E04C 5/16* (2006.01)

(52) U.S. Cl.
CPC ..... *E04G 21/185* (2013.01); *E04C 5/16* (2013.01); *E04G 11/00* (2013.01)

(58) Field of Classification Search
CPC . E04C 5/16; E04C 5/166; E04C 5/167; E04C 5/168; E04G 11/00; E04G 11/08; E04G 11/18; E04G 17/064; E04G 17/065; E04G 17/0658; E04G 21/185; E04F 2011/0214
See application file for complete search history.

(56) References Cited

U.S. PATENT DOCUMENTS 3,106,803 A * 10/1963 McRobbie ..... E04C 5/18 52/223.13
4,575,985 A * 3/1986 Eckenrodt ..... E04C 5/20 52/677
4,800,702 A * 1/1989 Wheeler ..... E04C 5/168 249/217
5,125,619 A 6/1992 Collins
5,174,083 A 12/1992 Mussell
5,218,795 A * 6/1993 Horstketter ..... B28B 23/00 52/125.5
5,388,804 A 2/1995 Cohen
5,688,428 A 11/1997 Maguire
5,852,907 A 12/1998 Tobin
5,937,604 A 8/1999 Bowron
6,021,994 A 2/2000 Shartzer, Jr.
6,591,574 B2 7/2003 Humphrey
6,898,912 B2 5/2005 Bravinski
7,467,777 B2 12/2008 Huber
7,934,693 B2 5/2011 Bravinski
9,163,783 B1 * 10/2015 McLaughlin ..... F16M 11/18
9,869,092 B1 * 1/2018 Rush ..... E04C 5/167
9,963,871 B2 * 5/2018 Clark, Jr. ..... E04B 1/41
2006/0059842 A1 3/2006 McCafferty Babcock
2012/0087742 A1 * 4/2012 Ogorchock ..... E02D 29/02 405/262
2015/0284967 A1 * 10/2015 Kim ..... E04C 5/125 52/125.4

(Continued)

*Primary Examiner* — Christine T Cajilig
(74) *Attorney, Agent, or Firm* — Jeffrey A. Proehl; Woods, Fuller, Shultz & Smith, PC

(57) ABSTRACT

A system includes a form panel positioning apparatus for positioning an elevated form panel of a concrete form. The apparatus may include at least one positioning subassembly providing positioning of the form panel in at least one direction, and may include a first positioning subassembly with a first clip to clip onto an element of a concrete reinforcement structure, a first support rod engageable with the first clip, and a first positioning plate positionable on the rod adjacent to the form panel to support the form panel on the rod. The system may include a second positioning subassembly for positioning the form panel such that the form panel is supported in two directions, such as substantially vertical and substantially horizontal directions.

12 Claims, 12 Drawing Sheets

(56) References Cited

U.S. PATENT DOCUMENTS

| | | | | |
|---|---|---|---|---|
| 2016/0222663 | A1* | 8/2016 | Mauz | E04C 5/206 |
| 2018/0223533 | A1* | 8/2018 | Rush | E04C 5/166 |
| 2019/0284824 | A1* | 9/2019 | Thompson | E04G 17/02 |

* cited by examiner

APPARATUS AND METHOD FOR SUPPORTING AN ELEVATED FORM PANEL

BACKGROUND

Field

The present disclosure relates to concrete forming apparatus and more particularly pertains to a new apparatus and method for supporting an elevated form panel which may utilize elements of a concrete reinforcement structure for enhanced support.

SUMMARY

In one aspect, the present disclosure relates to a system for forming a cast in place concrete slab, and the system may comprise a form panel positioning apparatus for positioning an elevated form panel in an elevated condition above a lower vertical boundary of a concrete form defining a concrete placement space with a concrete reinforcement structure in the placement space. The form panel positioning apparatus may comprise at least one positioning subassembly providing positioning of the elevated form panel in at least one direction, and the at least one positioning subassembly may include a first positioning subassembly configured to provide positioning of the elevated form panel in a first direction. The first positioning subassembly may comprise a first clip configured to removably clip onto a first reinforcement element of the concrete reinforcement structure extending below a desired elevated position of the elevated form panel, with the first clip including a first base portion defining a first channel having a threaded surface and a pair of first arm portions each extending from the first base portion to form a cavity between the pair of first arm portions to receive a portion of the first reinforcement element. The first positioning subassembly may also comprise a first support rod insertable into the first channel of the first clip, at least a portion of an outer surface of the first support rod being threaded to engage threads on the first clip such that rotation of the first clip with respect to the first support rod in a first rotational direction causes the first clip to move in a first longitudinal direction with respect to the first support rod to move the first arm portions in the first longitudinal direction and rotation of the first clip with respect to the first support rod in a second rotational direction causes the first clip to move in a second longitudinal direction with respect to the first support rod to move the first arm portions in the second longitudinal direction. The first positioning subassembly may further comprise a first positioning plate mountable on the first support rod and positionable on the first support rod adjacent to the elevated form panel to support the elevated form panel on the first support rod, with the first positioning plate having a first passage to receive the first support rod with a threaded surface to engage threads on the first support rod such that rotation of the first positioning plate with respect to the first support rod in the first rotational direction causes the first positioning plate to move in the first longitudinal direction with respect to the first support rod and rotation of the first positioning plate with respect to the first support rod in the second rotational direction causes the first positioning plate to move in the second longitudinal direction with respect to the first support rod. The first positioning plate may have a first fastener aperture for receiving a fastener to fasten the first positioning plate to the elevated form panel.

In some embodiments, the form panel positioning apparatus may further include a second positioning subassembly.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
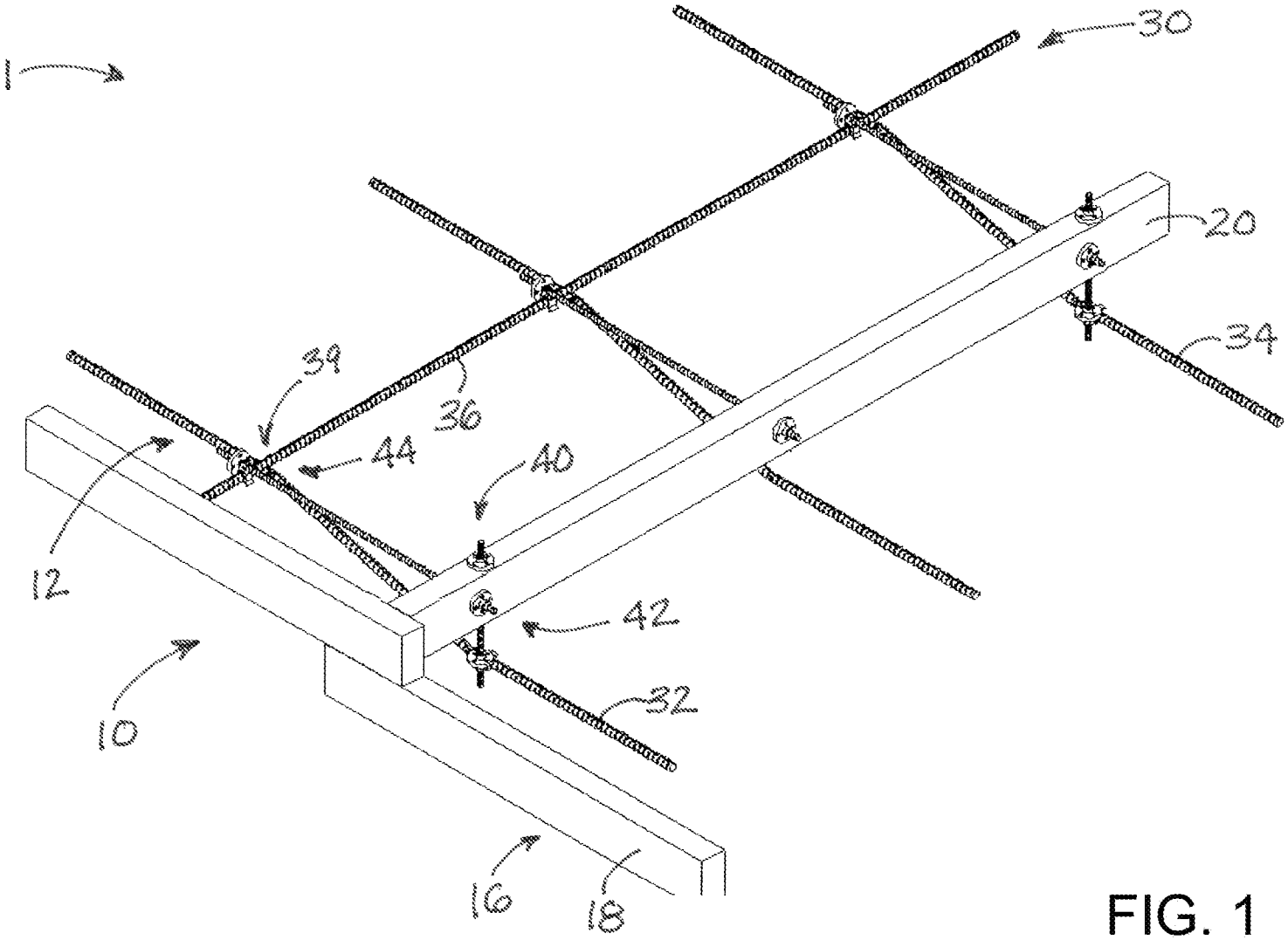
FIG. 1 is a schematic perspective view of a concrete forming system employing a new apparatus for supporting an elevated form panel according to the present disclosure.
Figure 2:
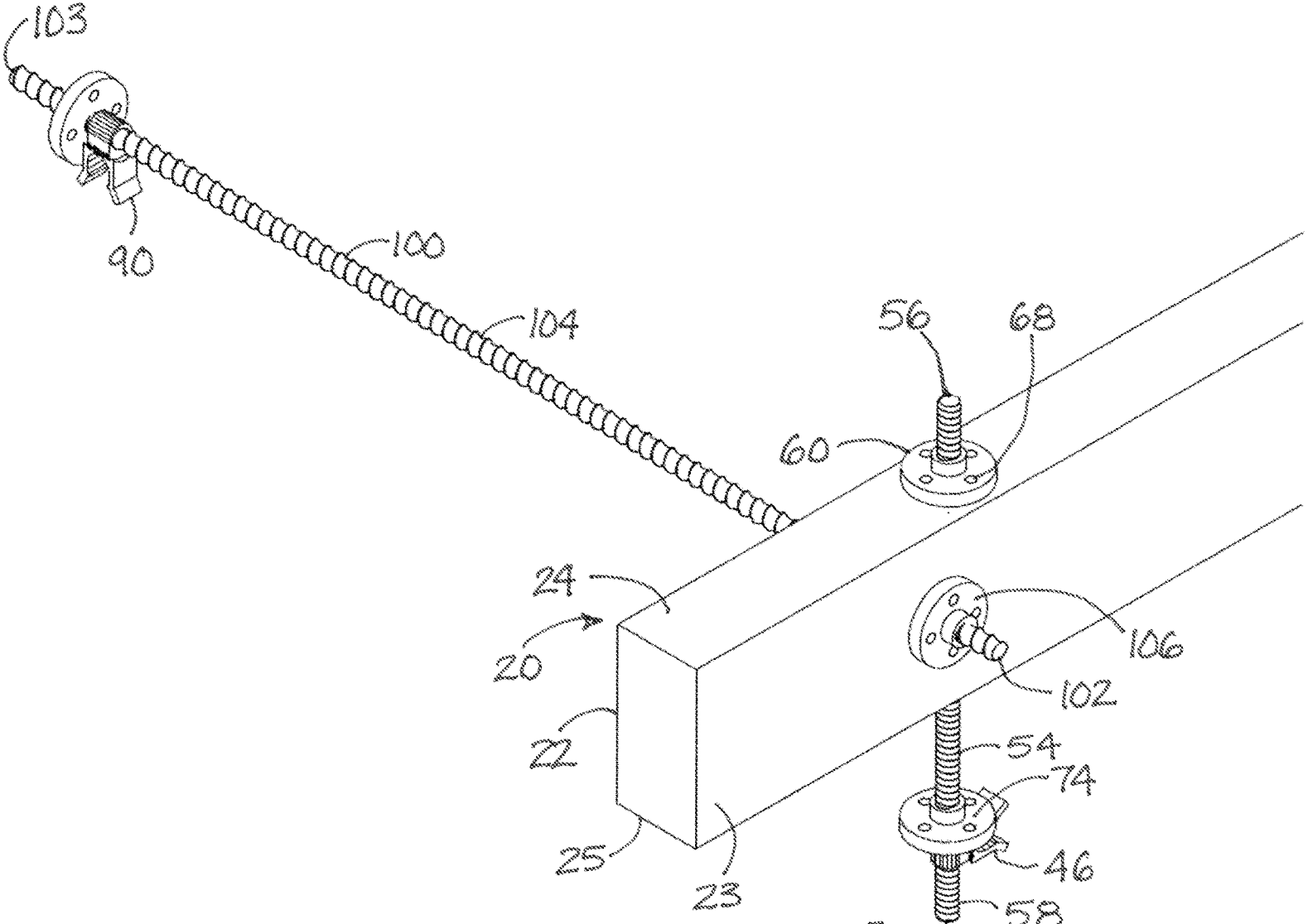
FIG. 2 is a schematic perspective view of elements of the apparatus enlarged and isolated from other elements of the system to show detail, according to an illustrative embodiment.
Figure 3:
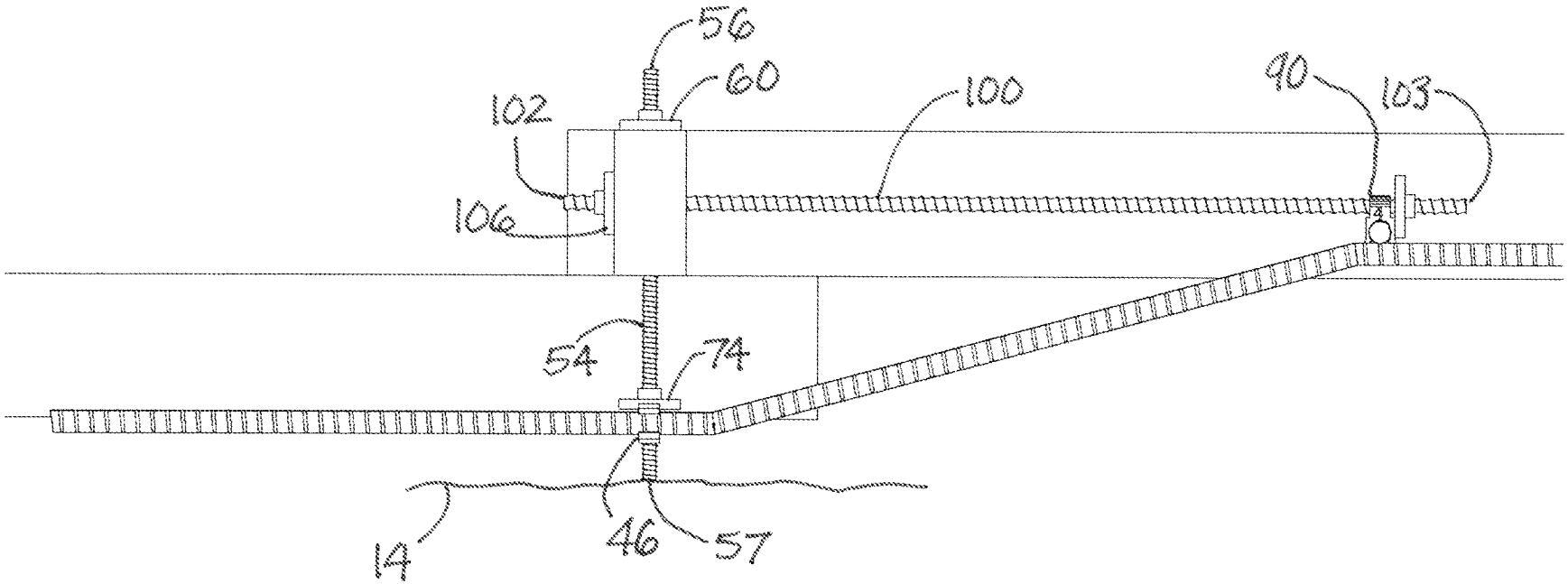
FIG. 3 is a schematic side view of elements of the apparatus enlarged and isolated to show detail, according to an illustrative embodiment.
Figure 4:
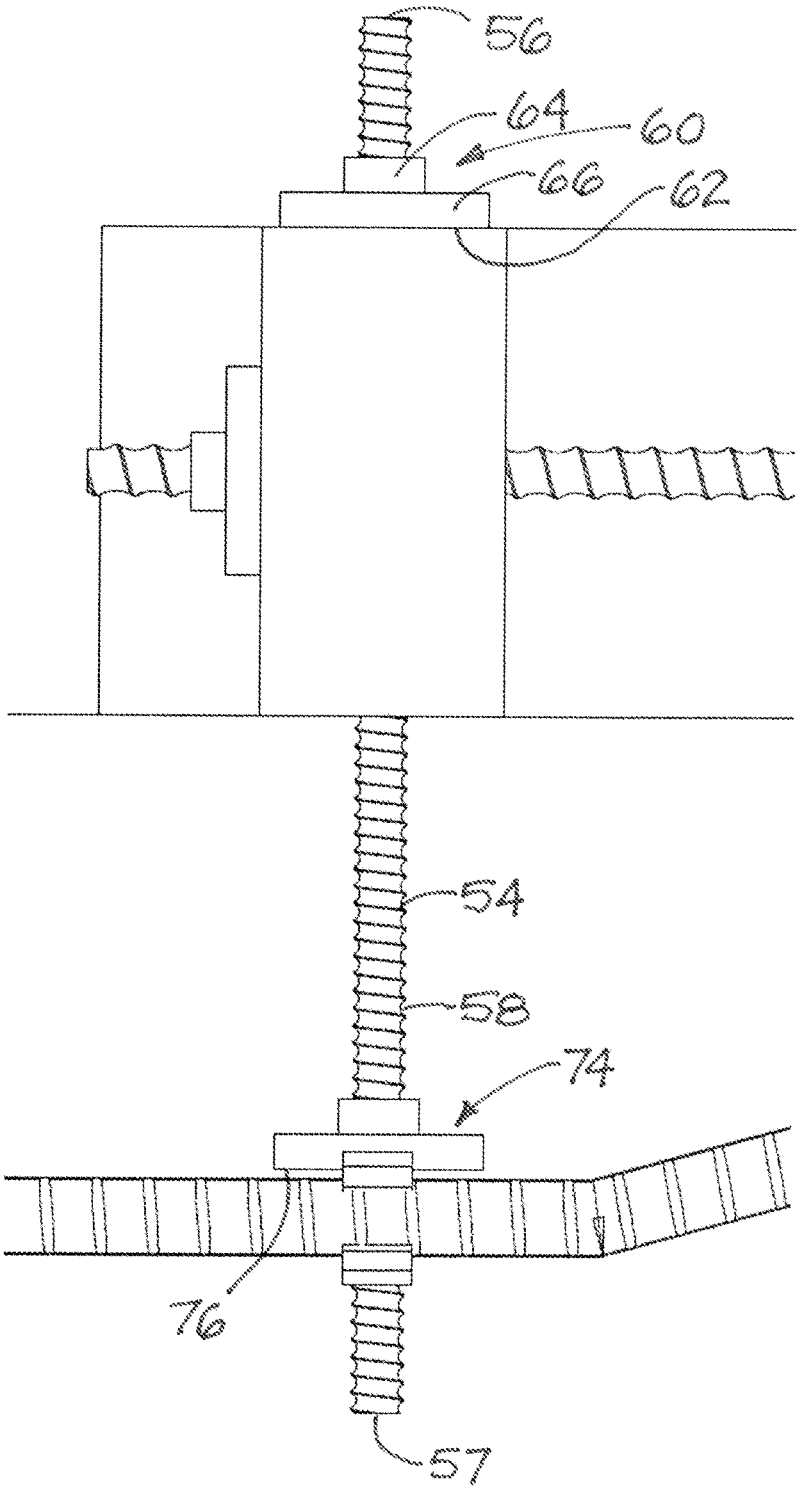
FIG. 4 is a schematic side view of elements of the apparatus and system enlarged to show detail, according to an illustrative embodiment.
Figure 5:
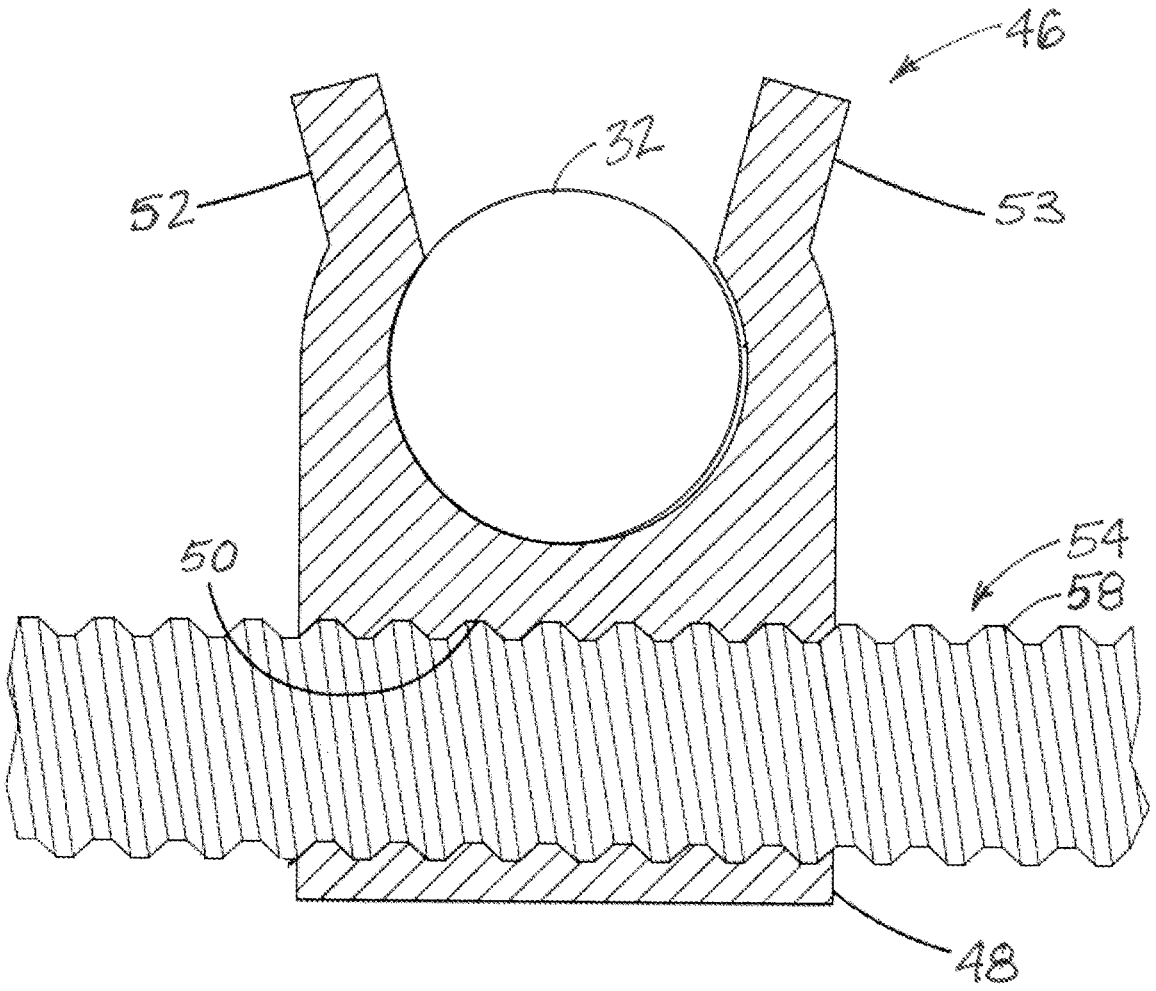
FIG. 5 is a schematic sectional view of the first support rod and first support clip of the apparatus mounted on the first reinforcement element of the system, according to an illustrative embodiment.
Figure 6:
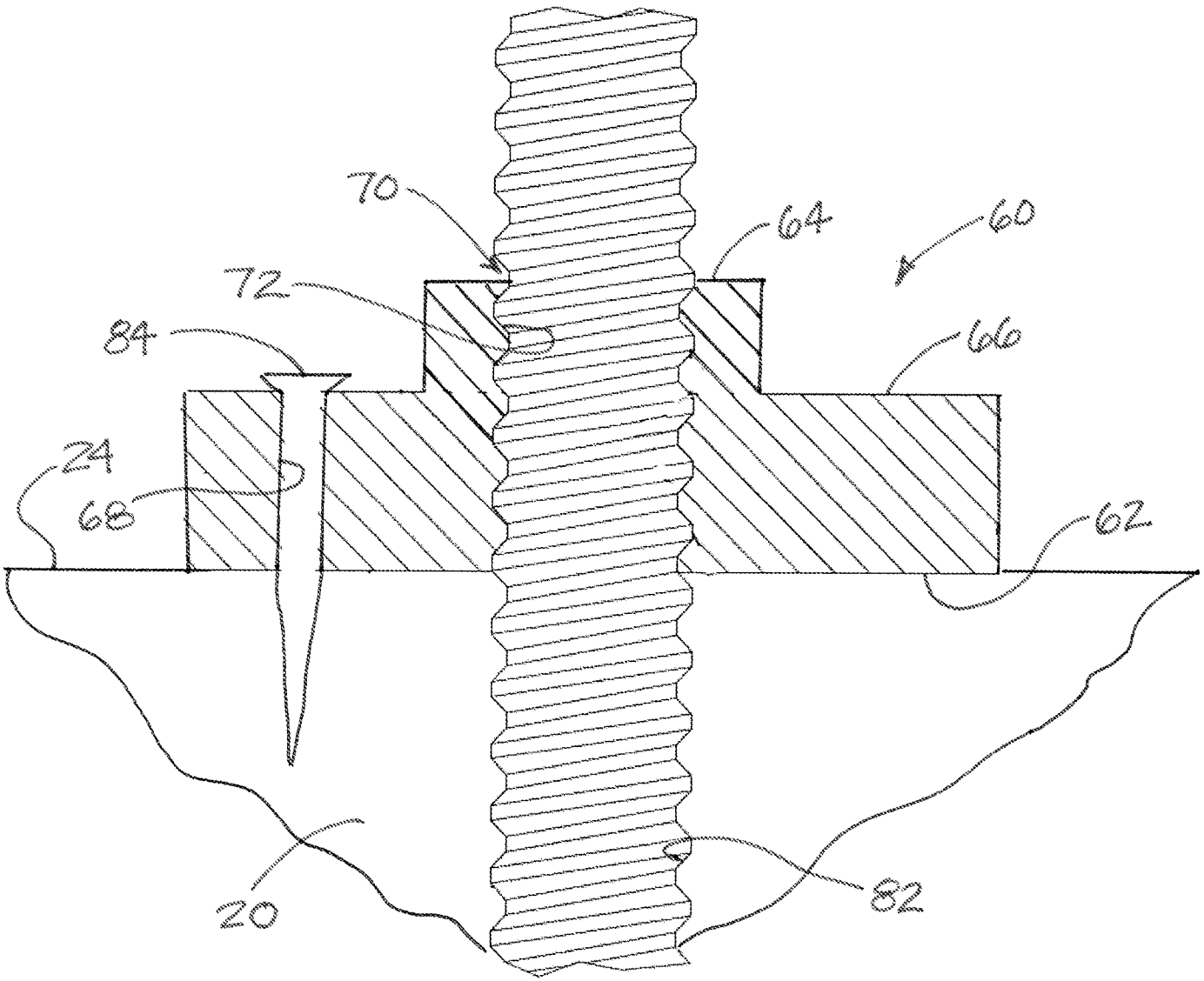
FIG. 6 is a schematic sectional view of the first support rod and first positioning plate of the apparatus secured to the elevated form panel of the system, according to an illustrative embodiment.
Figure 7:
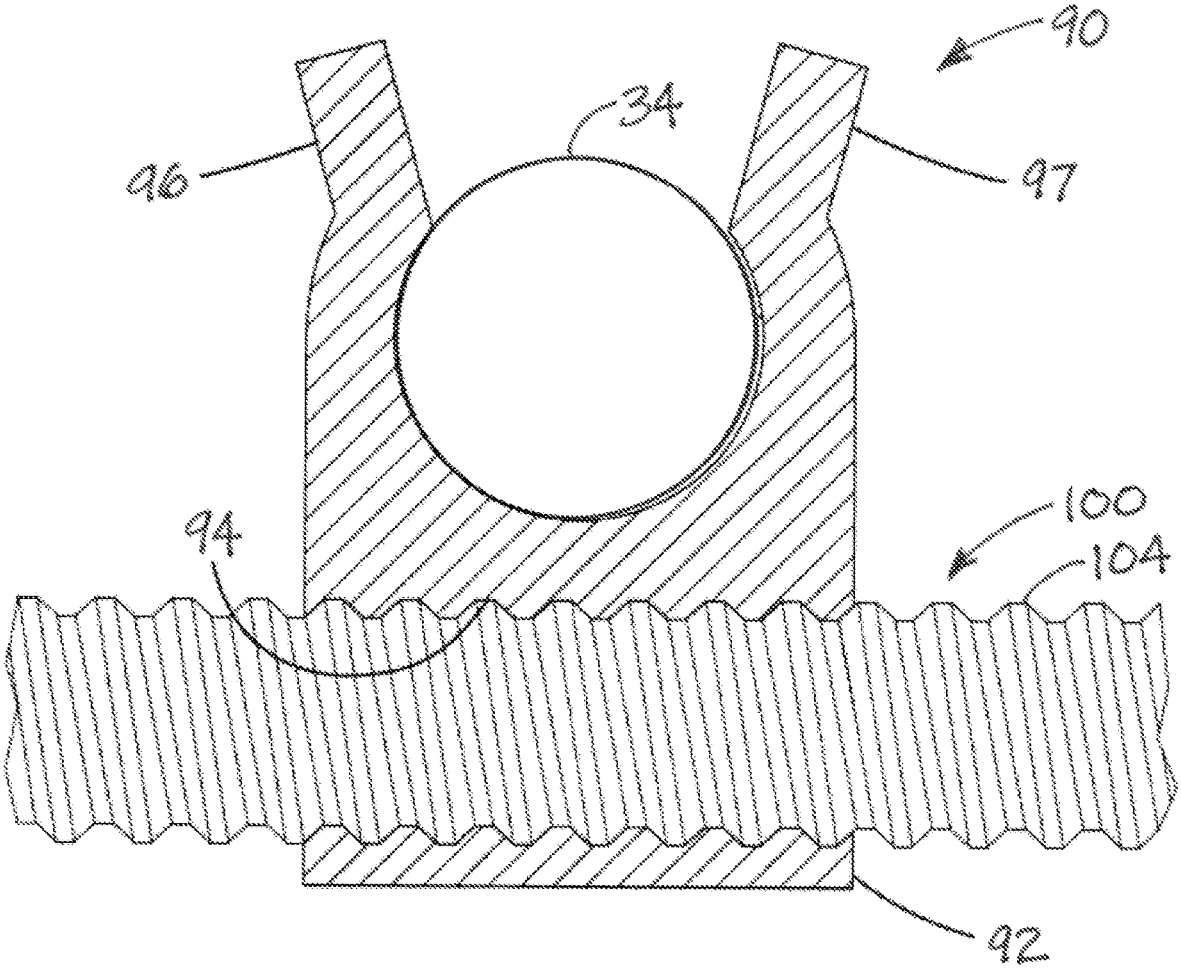
FIG. 7 is a schematic sectional view of the second support rod and second support clip of the apparatus mounted on the second reinforcement element of the system, according to an illustrative embodiment.
Figure 8:
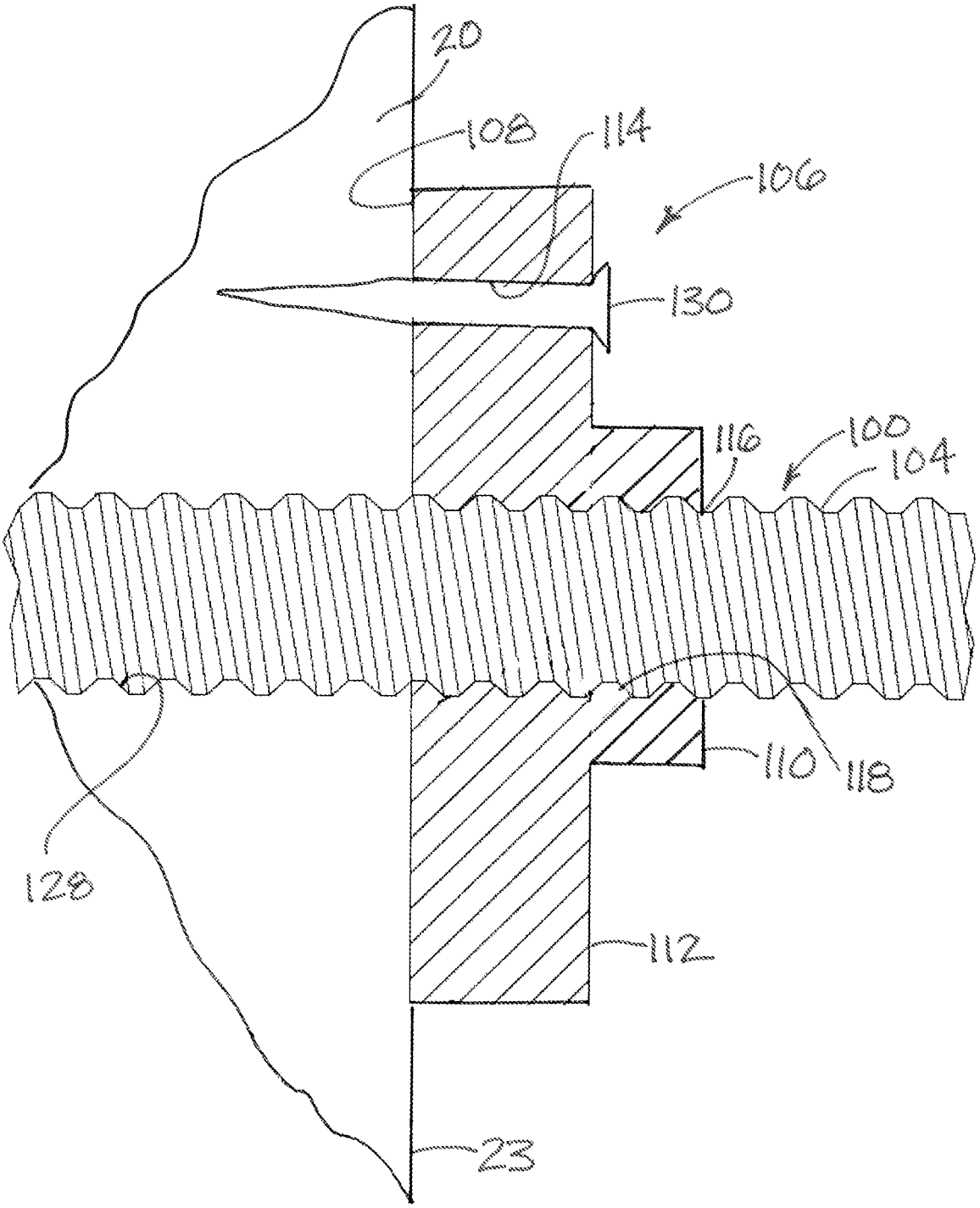
FIG. 8 is a schematic sectional view of the second support rod and second positioning plate of the apparatus secured to the elevated form panel of the system, according to an illustrative embodiment.
Figure 9:
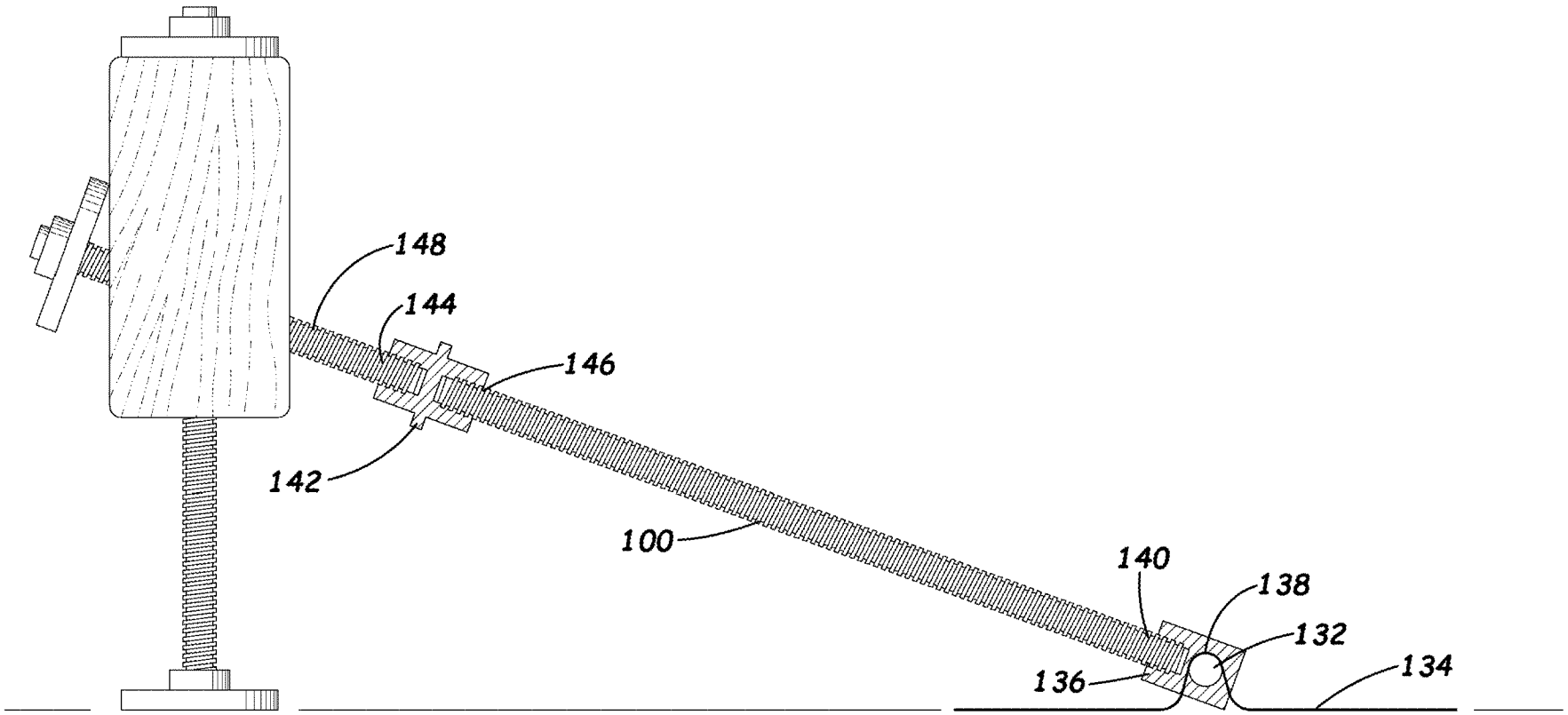
FIG. 9 is a schematic side view of an illustrative embodiment of the apparatus with various optional elements.

With reference now to the drawings, and in particular to FIGS. 1 through 12 thereof, a new apparatus and method for supporting an elevated form panel embodying the principles and concepts of the disclosed subject matter will be described.

In one aspect, the disclosure relates to a system 1 for forming a slab of concrete which is typically cast in place, but could optionally be applied in the case of a precast concrete slab intended to be moved to its final permanent location. In some embodiments, the system 1 may include a concrete form 10 which at least partially defines a concrete placement space 12 which is prepared for receiving the placement of concrete when in a flowable condition (e.g., prior to setting up) such that the concrete is able to flow into the space 12 and substantially fill the space 12 defined by the form 10. The space 12 may be defined along a lower vertical boundary 14 which in many cases may be the surface of the ground below the slab to be formed, and may be prepared, for example, with a sheet material placed over the ground surface such as a vapor barrier. The portion of the concrete form 10 located vertically opposite of the lower vertical boundary 14 is typically open to receive the concrete during pouring or placement of the concrete into the form, the then finishing of the surface of the concrete as the concrete is setting up.

In some embodiments, the concrete form 10 may include a perimeter form assembly 16 which forms at least a portion of a horizontal perimeter boundary of the placement space 12, and is typically (although not necessarily) a continuous boundary extending about the space 12. The perimeter form assembly 16 may include at least two elongated panels 18 positionable at the horizontal perimeter boundary of the space 12, and often three or four or more of the panels 18 may be utilized to form the boundary. The panels 18 may be positioned adjacent to each other to form the horizontal perimeter boundary and optionally may be positioned end to end to each other to form the continuous boundary. Often the elongated panels 18 may be positioned adjacent to the lower vertical boundary 14, and may be rested in contact with the lower vertical boundary. In the case of forming a slab, the elongate panels are typically narrow, and may be constituted of nominal 2" by 4" or 2" by 6" wooden boards, although other materials may be used for the elongate form panels.

The concrete form 10 may also include an elongated elevated form panel 20 which may be used to form a discontinuity in the upper surface of the placed concrete slab, such as, for example, to form the riser face of a step in the concrete slab or other vertical transition in the upper surface. The elevated form panel 20 may be positioned in a spaced relationship above the lower vertical boundary 14 of the placement space 12, such that the elevated form panel typically does not rest upon or directly contact the boundary 14. During placement of the concrete in the form 10, the elevated form panel 20 may be configured to hold back a portion of the flowing concrete in the concrete form until the concrete sets up or hardens sufficiently such that the place concrete is able to hold the shape of the riser face once the form panel 20 has been removed from the remainder of the form 10.

In some illustrative embodiments, the elevated form panel 20 may have a pair of opposite broad faces 22, 23 which may be oriented substantially vertically when positioned as part of the form 10. A first broad face 22 may be an inner broad face which is configured to abut and contact concrete placed in the form 10 to form the riser face, and a second broad face 23 may be an outer broad face which is typically free of contact with the placed concrete. The elevated form panel 20 may also include a pair of opposite narrow faces 24, 25 which may be oriented substantially horizontally when positioned in the form 10. A first narrow face 24 may be oriented upwardly or in an upward direction, and a second narrow face 25 may be a lower narrow face which is oriented downwardly or in a downward direction. Often, the lower narrow face 25 may abut against the portion of the concrete placed in the concrete form which is located adjacent to a lower end of the riser face to be formed by the slab. In some implementations, ends of the elongated elevated form panel 20 may be attached or otherwise connected to portions of the perimeter form assembly 16, such as to, for example, elongated panels 18 positioned on opposite sides of the concrete placement space 12.

The system 1 may also include a concrete reinforcement structure 30 which is utilized to reinforce the concrete of the slab, and is typically positioned in the concrete placement space 12 prior to placement of the concrete into the space 12 so that the flowing concrete is able to flow about and encompass the reinforcement structure 30. Illustratively, the concrete reinforcement structure 30 may include at least one reinforcement element 32 which is oriented in a first direction. The first direction may be substantially horizontally oriented, and may be oriented substantially parallel to the lower vertical boundary 14, such as the ground surface. The first direction may also be oriented substantially perpendicular to the direction in which the elevated form panel 20 extends. Typically, a plurality of first reinforcement elements 32, 34 are positioned in the placement space 12, and the elements 32, 34 may extend in the first direction and be oriented substantially parallel to each other.

The concrete reinforcement structure 30 may also include at least one second reinforcement element 36 which is oriented in a second direction. The second direction may be substantially horizontally oriented, and may be oriented substantially parallel to the lower vertical boundary 14, such as the ground surface. The second direction may be oriented substantially perpendicular to the first direction, and may be oriented substantially parallel to the direction in which the elevated form panel 20 extends. Typically, a plurality of the second reinforcement elements 36 are positioned in the placement space 12, and the elements 36 may extend in the second direction and be oriented substantially parallel to each other.

In many embodiments, the first and second reinforcement elements may cross each other at crossing points 39 and may be united together at the crossing points to form a reinforcement mat or grid which is incorporated into the concrete slab after concrete placement. Illustratively, each of the first and second reinforcement elements may comprise a reinforcement bar, or "rebar," which may include surface contours or ridges to help lock the longitudinal position of the reinforcement elements in the placed concrete. The rebar of the first and second reinforcement elements may be united or tied together at the crossing points in a suitable manner, such as, for example, by utilizing wire ties. Optionally, the first and second reinforcement elements may be integrally formed together as a mat which is positioned in the placement space 12.

The system 1 may include a form panel positioning apparatus 40 configured to position or support the elevated form panel 20 in an elevated condition above the lower vertical boundary 14 of the concrete form 10, and typically at an upper boundary of the concrete placement space 12. The positioning apparatus 40 may also serve to reinforce sections of the elevated form panel 20 which are cantilevered between attachments of the panel 20 to the perimeter form assembly 16, such as at the ends of the panel 20. Advantageously, the positioning apparatus 40 may resist bulging or bowing of the elevated form panel during the placement of the flowing concrete due to the force applied by the weight and movement of concrete flowing into and distributing across the placement space 12.

The form panel positioning apparatus 40 may include a pair of positioning subassemblies 42, 44 which may provide positioning of the elevated form panel 20 in at least two directions, and the two directions may be oriented substantially perpendicular to each other. For example, one of the two directions may be a vertical direction and the other of the two directions may be a horizontal direction. However, in other implementations the directions of positioning and support may be oriented at oblique angles with respect to each other.

A first positioning subassembly 42 may be configured to provide positioning of the elevated form panel, for example, in a vertical or substantially vertical direction such as, illustratively, against movement of the panel 20 in a downward direction toward the lower vertical boundary 14 and into the placement space 12. The first positioning subassembly 42 may include a first clip 46 which is configured to removably clip onto one of the first reinforcement elements 32, 34 which extend below the desired elevated position of the elevated form panel 20.

Illustratively, the first clip 46 may include a first base portion 48 which defines a first channel 50 which may have an interior surface which is at least partially threaded. The first clip may also include a pair of first arm portions 52, 53 with each arm portion extending from the first base portion to form a cavity between the first arm portions to receive a portion of one of the first reinforcement elements. The pair of first arm portions 52, 53 may extend in substantially the same direction from the first base portion, and may have opposing clasping surfaces on either side of the cavity. The first arm portions may extend in a direction that is perpendicular to an axis of the first channel 50 and extend in the same plane as the first channel. As such, the pair of first arm portions may be oriented with respect to the first channel 50 such that the first channel is generally vertically oriented when the first clip 46 is clipped on one of the first reinforcement elements. Optionally, additional securement may be provided through the use of a loop extending about the distal sections of the arm portions to further trap the rod between the loop and the base portion of the clip to provide additional securement between the clip and the reinforcement element. The loop may be formed of any suitable elements, including, for example, a wire or a cable tie.

The first positioning subassembly 42 may also include a first support rod 54 which may be configured to be inserted into the first channel 50 of the first clip 46. The first support rod may have opposite ends 56, 57 with an outer surface 58 extending between the ends. Positioning of the first clip on the first support rod in a manner secure against unintended movement of the clip along the rod may be accomplished by any suitable structure. Illustratively, at least a portion of the outer surface 58 of the first support rod 54 may be threaded to engage threads formed on the surface of the first channel 50 of the first clip. As a result of the threaded relationship between the first clip and the first support rod, rotation of the clip 46 with respect to the rod 54 may adjust the relative position of the clip on the rod. For example, rotation of the first clip with respect to the first support rod in a first rotational direction may cause the first clip to move in a first longitudinal direction with respect to the first support rod to move the first support arms in a first longitudinal direction, and rotation of the first clip with respect to the first support rod in a second rotational direction may cause the first clip to move in a second longitudinal direction with respect to the first support rod to move the first arm portions of the clip in the second longitudinal direction.

The first positioning subassembly may also include a first positioning plate 60 which may be mounted on the first support rod 54 to support the elevated form panel 20 on the first support rod. The first positioning plate 60 may be positionable adjacent to the elevated form panel 20, and may be abuttable against the elevated form panel. The first positioning plate 60 may be positioned adjacent to the upper narrow face 24 (or optionally the lower narrow face 25) of the panel 20 to permit attachment of the first positioning plate to the elevated form panel 20 to provide support to the form panel 20. The first positioning plate 60 may have a first abutment surface 62 for positioning against or in contact with the form panel 20. In some embodiments, the first positioning plate 60 may have a central portion 64 and a flange portion 66, and at least a portion of the abutment surface 62 may be located on the flange portion. The first positioning plate 60 may have a first fastener aperture 68 for receiving a fastener to fasten or attach the first positioning plate 60 to the elevated form panel 20 to secure the plate 60 and the panel 20 together. Illustratively, the first fastener aperture 68 may be located on the flange portion 66, and multiple fastener apertures may be formed on the flange portion.

The first positioning plate may have a first passage 70 which is configured to receive a portion of the first support rod 54. Positioning of the first positioning plate on the first support rod in a manner secure against unintended movement of the plate along the rod may be accomplished in any suitable manner. Illustratively, the first passage may be defined by a passage surface 72 with at least a portion of the passage surface 72 being threaded to engage threads on the outer surface 58 of rod 54. As a result of the threaded relationship between the plate 60 and the rod 54, rotation of the first positioning plate 60 with respect to the support rod 54 may adjust the relative position of the plate on the rod. For example, rotation of the first positioning plate with respect to the first support rod in a first rotational direction causes the first positioning plate to move in a first longitudinal direction with respect to the first support rod to thereby move the abutment surface 62 in the first longitudinal direction, and rotation of the first positioning plate with respect to the first support rod in a second rotational direction causes the first positioning plate to move in a second longitudinal direction with respect to the first support rod to thereby move the first abutment surface 62 in the second longitudinal direction.

The first positioning subassembly 42 may also include a first base plate 74 which is configured to mount on the first support rod 54 for resting upon the lower vertical boundary 14 of the concrete form. The first base plate 74 may be configured similar to the first positioning plate with, for example, a first base surface 76 for resting upon the lower vertical boundary and a first base passage for receiving at least a portion of the first support rod which is defined by a first base surface. A portion of the first base surface of the first base passage may be threaded to engage threads on the outer surface of the first support rod 54 to facilitate securing of the base plate 74 to the support rod as well as providing a degree of adjustment of the position of the base plate on the support rod. Optionally, in some implementations the first base plate may be positioned adjacent to the first clip 46 and the first reinforcement element 32 in order to further reinforce the connection therebetween.

In some implementations, a first hole 82 may be provided in the elevated form panel 20 to accommodate a portion of the first support rod 54. Illustratively, the first hole may extend between the opposite narrow faces 24, 25 of the form panel 20 and may be substantially vertically oriented. A first fastener 84 may be utilized to attach the elevated form panel to the first positioning plate 60 by passing the first fastener through the first fastener aperture 68 of the positioning plate 60 to fasten the plate to the panel 20. Optionally, multiple fasteners 84 may be utilized in multiple fastener apertures 68 to secure the attachment.

A second positioning subassembly 44 may be configured to provide positioning of the elevated form panel, for example, in a horizontal or substantially horizontal direction against movement of the panel 20 in an outward direction from the second reinforcement element. The second positioning subassembly 44 may include a second clip 90 which is configured to removably clip onto one of the second reinforcement elements 36 which may extend to one side of, and generally below, the desired elevated position of the elevated form panel 20.

Illustratively, the second clip 90 may include a second base portion 92 which defines a second channel 94 which may have an interior surface which is at least partially threaded. The second clip may also include a pair of second arm portions 96, 97 with each arm portion extending from the second base portion to form a cavity between the second arm portions to receive a portion of one of the second reinforcement elements. The pair of second arm portions 96, 97 may extend in substantially the same direction from the second base portion with opposing clasping surfaces on opposite sides of the cavity. The second arm portions may extend in a direction that is perpendicular to an axis of the second channel 94 and may extend in the same plane as the second channel. The second arm portions may be oriented such that the second channel is generally horizontally oriented when the second clip 90 is clipped on one of the second reinforcement elements, although in some implementations the second channel may have an orientation that is somewhat inclined upwardly from the horizontal. As an option, additional securement in the form of a loop extending about the distal sections of the arm portions may be utilized to further secure the reinforcement element to the base portion of the clip.

The second positioning subassembly 44 may also include a second support rod 100 which may be inserted into the second channel 94 of the second clip. The second support rod may have opposite ends 102, 103 with an outer surface 104 between the ends. Adjustable positioning of the second clip 90 on the second support rod 100 in a secure manner resistant to unintended movement of the clip along the rod may be provided by suitable structure. Illustratively, at least a portion of the outer surface 104 may be threaded to engage threads formed on the surface of the second channel 94 of the second clip. As a result of the threaded relationship between the second clip and the second support rod, rotation of the second clip with respect to the second support rod may adjust the relative position of the clip on the rod. For example, rotation of the second clip 90 with respect to the rod 100 in a first rotational direction may cause the second clip to move in a first longitudinal direction with respect to the second support rod to move the second support arms in a first longitudinal direction, and rotation of the second clip with respect to the second support rod in a second rotational direction may cause the second clip to move in a second longitudinal direction with respect to the second support rod to move the second arm portions of the clip in the second longitudinal direction.

The second positioning subassembly may also include a second positioning plate 106 which may be mounted on the second support rod 100 to support the elevated form panel 20 on the second support rod. The second positioning plate 106 may be positionable adjacent to, and abuttable against, the elevated form panel 20. The second positioning plate 106 may be positioned adjacent to the inner broad face 22 (or optionally the outer broad face 23) of the panel 20 to permit attachment of the second positioning plate to the elevated form panel 20 to provide support to the form panel 20. The second positioning plate 106 may have a second abutment surface 108 for positioning against or in contact with the form panel 20. In some embodiments, the second positioning plate 106 may have a central portion 110 and a flange portion 112, and at least a portion of the abutment surface 108 may be located on the flange portion. The second positioning plate 106 may have a second fastener aperture 114 for receiving a fastener to fasten or attach the second positioning plate 106 to the elevated form panel 20. The second fastener aperture 114 may be located on the flange portion 112, and may include multiple apertures 114.

The second positioning plate 106 may have a second passage 116 which is configured to receive a portion of the second support rod 100, and positioning of the second positioning plate on the second support rod in a manner suitable to secure the position of the plate on the rod against unintended movement may be provided. For example, the second passage of the plate 106 may have a second passage surface 118 with at least a portion of the passage surface 118 being threaded to engage threads on the outer surface 104 of rod 100. By this structure, rotation of the second positioning plate 106 with respect to the support rod 100 in a first rotational direction causes the second positioning plate to move in a first longitudinal direction with respect to the second support rod to thereby move the abutment surface 108 in the first longitudinal direction, and rotation of the second positioning plate with respect to the second support rod in a second rotational direction causes the second positioning plate to move in a second longitudinal direction with respect to the second support rod to thereby move the second abutment surface 108 in the second longitudinal direction. Additional plate structures may also be positioned on the second support rod 100 for purposes such as further securing the connection between the second clip 90 and the second reinforcement element 36.

In some implementations, the second support rod 100 may pass through a second hole 130 in the elevated form panel 20, and the second hole may extend between the opposite broad faces 22, 23 of the form panel 20. The second hole 130 may be substantially horizontally oriented to accommodate a portion of the second support rod 100. A second fastener 132 may be utilized to attach the elevated form panel to the second positioning plate 106 by passing the second fastener through the second fastener aperture 114 of the positioning plate 106 to fasten the plate to the panel 20. Optionally, multiple fasteners 132 may be utilized in multiple fastener apertures 114 to secure the attachment.

Additional elements and devices may also be useful for adopting the system to other situations and circumstances. For example, in situations where a reinforcement structure or mat is not utilized and thus not present in the concrete placement space 12, an auxiliary rod 132 (e.g., see FIG. 9) may be secured to the lower vertical boundary 14 of the placement space 12 in any suitable manner, such as by taping the rod 132 to a vapor barrier forming the boundary 14. One or more pieces of tape 134 may be placed across the auxiliary rod 132 and adhered to the vapor barrier to secure the rod 132 in position at the lower vertical boundary. An auxiliary connector 136 may have a channel 138 through which a portion of the auxiliary rod may extend. The surface forming the channel 138 may be threaded to facilitate secure positioning of the auxiliary connector on the auxiliary rod. The auxiliary rod may also have a socket 140 which receives an end of a support rod, such as the second support rod 100, which extends toward the elevated form panel 20.

An optional additional element is a breakback device 142 which may be mounted on a support rod and effectively form a break in the support rod between two segments of the support rod. The breakback device 142 may include two sockets 144, 146 which may be positioned at opposite ends of the device 142 and may have opposite orientations on the device 142 such that the sockets 144, 146 open in opposite directions of each other. Each of the sockets 144, 146 may be formed by a surface which is at least partially threaded to engage threads on one of the rods. One of the support rods, illustratively the second support rod 100, may be inserted or threaded into one of the sockets of the brakeback device and an auxiliary support rod 148 may be inserted or threaded into the other one of the sockets to extend through a hole in the form panel 20. The usage of the brakeback device 142 may facilitate removal of the auxiliary support rod from the placed concrete while leaving elements such as the (primary) support rod in situ in the placed concrete.

Figure 10:
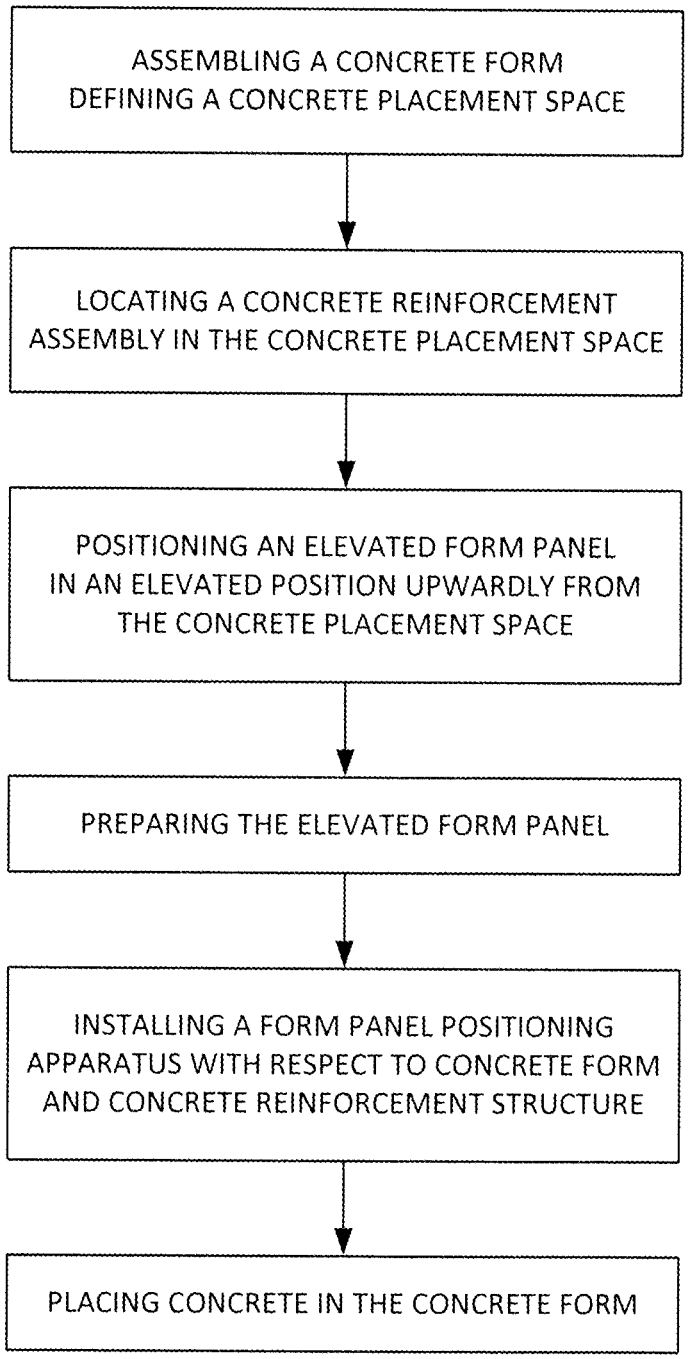
FIG. 10 is a schematic flow diagram of aspects of an implementation of a method associated with elements of the system.
Figure 11:
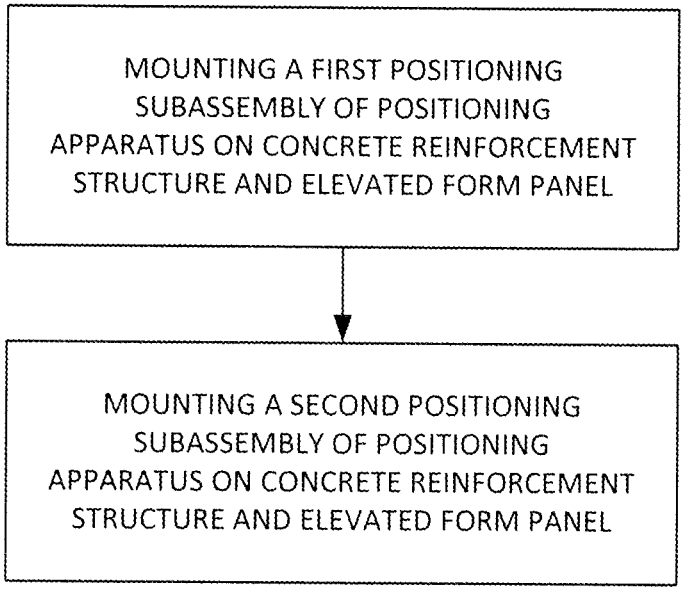
FIG. 11 is a schematic flow diagram of further aspects of an implementation of a method associated with elements of the system.
Figure 12:
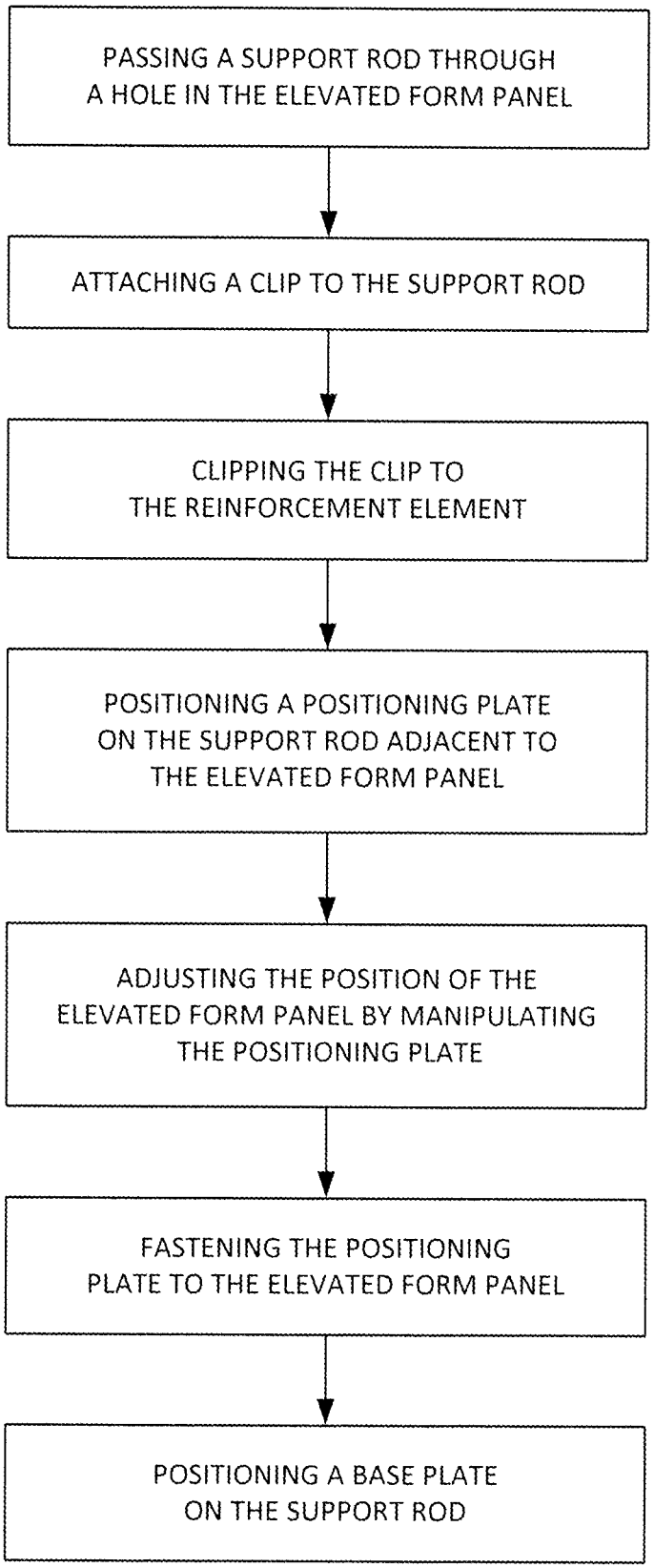
FIG. 12 is a schematic flow diagram of still further aspects of an implementation of a method associated with elements of the system.

An implementation of a method for utilizing aspects of the form panel positioning apparatus 40 and elements of the system 1, such as is illustratively depicted in FIGS. 10 through 12, will not be disclosed. An initial aspect of the method may to assemble a concrete form 10 to define a concrete placement space 12, and may include preparing a lower vertical boundary 14 of the form 10 (which may include placing a vapor barrier onto the ground surface to provide the boundary 14) and assembling a perimeter form assembly 16 which may include arranging at least two elongated panels 18 adjacent to the lower vertical boundary 14 about the placement space 12.

A further aspect of the method may include locating a concrete reinforcement structure 30 in the concrete placement space 12, which may include locating at least one first reinforcement element 32 and at least one second reinforcement element 36 in the space 12. This aspect of the method may include orienting the first and second reinforcement elements in substantially perpendicular relationships to each other within the space 12, and may also include attaching the reinforcement elements together at crossing points of the elements to form a reinforcement mat.

A still further aspect of the method may include positioning an elevated form panel 20 in an elevated position above the placement space 12, such as spaced vertically upwardly from the lower vertical boundary 14 of the concrete form.

The method may also include marking a mark on a location on the elevated form panel at a location which is substantially directly above one of the first reinforcement elements such that the mark is in substantial vertical alignment with the first reinforcement element, and may further include placing a mark at each location on the elevated form panel which is substantially vertically aligned with one of the first reinforcement elements.

Another aspect of the method may include preparing the elevated form panel 24 use with the form panel positioning apparatus 40. Such preparation may include forming a first hole 82 in the elevated form panel which may extend between the narrow faces 24, 25 of the panel and may be substantially vertically oriented, and the preparation may be effected by drilling the first hole through the elevated form panel. In some implementations, the location of the first hole 82 in the first form panel may be offset from the mark on the elevated form panel in a substantially horizontal direction along a length of the panel 20. Illustratively, the first hole may be offset by a distance of approximately 1 inch from the mark. Preparing the elevated form panel may also include forming a second hole 128 in the elevated form panel which may extend between the broad faces 22, 23 of the panel 20 and may be substantially horizontally oriented or may be slightly inclined downwardly, and may also be produced by drilling the second hole through the elevated form panel. Illustratively, the second hole 128 may be offset from the mark on the elevated form panel in a substantially horizontal direction along the length of the panel 20. Illustratively, the second hole may be offset by a distance of approximately 2 inches from the mark.

Further aspects of the method may include installing a form panel positioning apparatus 40 and may include mounting the positioning apparatus on the concrete form 10 and on the reinforcement structure 30 as well as engaging the elevated form panel 20. Installation of the positioning apparatus 40 may include mounting a first positioning subassembly 42 of the apparatus 40 on the concrete reinforcement structure and the elevated form panel, and may comprise passing a first support rod 54 to the first hole 82 in the form panel 20 such that the rod 54 extends downwardly from the form panel 20 toward the lower vertical boundary 14. Further, mounting of the first positioning subassembly may include attaching a first clip 46 of the apparatus 40 to the first support rod 54 and may be accomplished by inserting a portion of the first support rod into a first channel 50 of the clip 46 such as by threading the portion of the support rod 54 into the first channel until the clip reaches a suitable location on the rod. Mounting the subassembly 42 may also include clipping the first clip 46 on the first reinforcement element 32 and may include positioning the first clip on the reinforcement element at a location which is substantially vertically aligned with the elevated form panel 20.

Another aspect of the mounting of the first positioning subassembly 42 may include positioning of the first positioning plate 60 of the positioning apparatus 40 on the first support rod 46, such as inserting a portion of the rod 46 which protrudes from one of the narrow faces of the elevated form panel until a first abutment surface 62 of the plate is adjacent to the narrow face of the panel. Insertion of the support rod 54 into the positioning plate 60 may include threading the first positioning plate on to the first support rod and rotating the plate and the rod with respect to each other to advance the plate toward the narrow face of the form panel to achieve adjacency, if not contact, therebetween. Adjustment of a vertical position of the elevated form panel 20 may be accomplished by rotating the first positioning plate 60 with respect to the first support rod to raise or lower the panel 20 to a desired position with respect to, for example, the lower vertical boundary 14. Finally, fastening of the first positioning plate 60 to the elevated form panel 20 may be accomplished by passing a first fastener 84 through a first fastener aperture 68 in the positioning plate and then into the elevated form panel.

The method may also include positioning a first base plate 74 on the first support rod 54 and may include positioning the base plate 54 adjacent to the lower vertical boundary 14 to support the first support rod on the boundary 14. Optionally, a first base plate 74 may be positioned adjacent to the first clip 46 on the first support rod in a location between the first clip and the elevated form panel.

Additional aspects of installing the form panel positioning apparatus 40 may include mounting a second positioning subassembly 44 of the apparatus 40 on the concrete reinforcement structure and the elevated form panel, and may comprise passing a second support rod 100 to the second hole 128 in the form panel 20 such that the rod 100 extends substantially horizontally (or horizontally and slightly downwardly) from the form panel 20 toward one of the second reinforcement elements 36. Further, mounting of the second positioning subassembly may include attaching a second clip 90 of the apparatus 40 to the second support rod 100 and may be accomplished by inserting a portion of the second support rod into a second channel 94 of the clip 90 such as by threading the portion of the support rod 100 into the second channel until the clip reaches a suitable location on the rod. Mounting the subassembly 44 may also include clipping the second clip 90 on the second reinforcement element 36 and may include positioning the second clip on the reinforcement element at a location which is substantially aligned in a horizontal plane with the second hole 128 in the elevated form panel 20.

Another aspect of the mounting of the second positioning subassembly 44 may include positioning of the second positioning plate 106 of the positioning apparatus 40 on the second support rod 100, such as inserting a portion of the rod 100 which protrudes from one of the broad faces of the elevated form panel until a second abutment surface 108 of the plate is adjacent to the broad face of the panel. Insertion of the support rod 100 into the positioning plate 106 may include threading the second positioning plate on to the second support rod and rotating the plate and the rod with respect to each other to advance the plate toward the broad face of the form panel to achieve adjacency, if not contact, therebetween. Adjustment of a horizontal position of the elevated form panel 20 may be accomplished by rotating the second positioning plate 106 with respect to the second support rod to move the panel 20 inwardly or outwardly in a generally horizontal direction. Finally, fastening of the second positioning plate 106 to the elevated form panel 20 may be accomplished by passing a second fastener 130 through a second fastener aperture 114 in the positioning plate and then into the elevated form panel.

The method may also include, if not previously accomplished, securing the elevated form panel 20 to other elements of the concrete form 10, such as fastening the end or ends of the form panel 22 one of the elongated panels 18 of the perimeter form assembly 16.

The method may conclude with placing the concrete in the concrete form 10, and more specifically positioning the concrete in the placement space 12 defined by the form 10

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, substeps may be performed in parallel, shown steps may be omitted, or other steps may be included, etc.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A system for forming a cast in place concrete slab, the system comprising:

a concrete form at least partially defining a concrete placement space prepared for receiving the placement of concrete, the space being defined along a lower vertical boundary;

an elevated form panel configured to form a discontinuity in an upper surface of the cast in place concrete slab; and a form panel positioning apparatus for positioning the elevated form panel in an elevated condition above and in a spaced relationship with the lower vertical boundary of a concrete form defining a concrete placement space with a concrete reinforcement structure in the placement space, the form panel positioning apparatus comprising:

at least one positioning subassembly providing positioning of the elevated form panel in at least one direction, the at least one positioning subassembly including:

a first positioning subassembly configured to provide positioning of the elevated form panel in a substantially vertical direction, the first positioning subassembly comprising:

a first clip configured to removably clip onto a first reinforcement element of the concrete reinforcement structure extending below a desired elevated position of the elevated form panel, the first clip including a first base portion defining a first channel having a threaded surface and a pair of first arm portions each extending from the first base portion to form a cavity between the pair of first arm portions to receive a portion of the first reinforcement element;

a first support rod insertable into the first channel of the first clip, at least a portion of an outer surface of the first support rod being threaded to engage threads on the first clip such that rotation of the first clip with respect to the first support rod in a first rotational direction causes the first clip to move in a first longitudinal direction with respect to the first support rod to move the first arm portions in the first longitudinal direction and rotation of the first clip with respect to the first support rod in a second rotational direction causes the first clip to move in a second longitudinal direction with respect to the first support rod to move the first arm portions in the second longitudinal direction;

a first positioning plate mountable on the first support rod and positionable on the first support rod adjacent to the elevated form panel to support the elevated form panel on the first support rod, the first positioning plate having a first passage to receive the first support rod with a threaded surface to engage threads on the first support rod such that rotation of the first positioning plate with respect to the first support rod in the first rotational direction causes the first positioning plate to move in the first longitudinal direction with respect to the first support rod and rotation of the first positioning plate with respect to the first support rod in the second rotational direction causes the first positioning plate to move in the second longitudinal direction with respect to the first support rod, the first positioning plate being fastenable to the elevated form panel.

2. The system of claim 1 wherein the at least one positioning subassembly of the form panel positioning apparatus additionally comprises:

a second positioning subassembly configured to provide positioning of the elevated form panel in a second direction oriented substantially perpendicular to the substantially vertical direction, the second positioning subassembly comprising:

a second clip configured to removably clip onto a second reinforcement element of the concrete reinforcement structure extending adjacent to the desired elevated position of the elevated form panel, the second clip including a second base portion defining a second channel having a threaded surface and a pair of second arm portions each extending from the second base portion to form a cavity between the pair of second arm portions to receive a portion of the second reinforcement element;

a second support rod insertable into the second channel of the second clip, at least a portion of an outer surface of the second support rod being threaded to engage threads on the second clip such that rotation of the second clip with respect to the second support rod in a first rotational direction causes the second clip to move in a first longitudinal direction with respect to the second support rod to move the second arm portions in a first longitudinal direction and rotation of the second clip with respect to the second support rod in a second rotational direction causes the second clip to move in a second longitudinal direction with respect to the second support rod to move the second arm portions in the second longitudinal direction;

a second positioning plate mountable on the second support rod and positionable on the second support rod adjacent to the elevated form panel to support the elevated form panel on the second support rod, the second positioning plate having a second passage to receive the second support rod with a threaded surface to engage threads on the second support rod such that rotation of the second positioning plate with respect to the second support rod in the first rotational direction causes the second positioning plate to move in the first longitudinal direction with respect to the second support rod and rotation of the second positioning plate with respect to the second support rod in the second rotational direction causes the second positioning plate to move in the second longitudinal direction with respect to the second support rod, the second positioning plate having a second fastener aperture for receiving fastener to fasten the second positioning plate to the elevated form panel.

3. The system of claim 2 wherein the second positioning subassembly is configured to position the elevated form panel in a substantially horizontal direction.

4. The system of claim 1 wherein the first positioning plate has a first abutment surface for abutting against the elevated form panel.

5. A system for forming a cast in place concrete slab, the system comprising:

a concrete form at least partially defining a concrete placement space prepared for receiving the placement of concrete, the space being defined along a lower vertical boundary;

an elevated form panel configured to form a discontinuity in an upper surface of the cast in place concrete slab, the first positioning plate and the second positioning plate each being positioned against the elevated form panel; and a form panel positioning apparatus for positioning the elevated form panel in an elevated condition above the lower vertical boundary of the concrete form defining the concrete placement space with a concrete reinforcement structure in the placement space, the form panel positioning apparatus comprising:

at least one positioning subassembly providing positioning of the elevated form panel in at least one direction, the at least one positioning subassembly including:

a first positioning subassembly configured to provide positioning of the elevated form panel in a first direction, the first positioning subassembly comprising:

a first clip configured to removably clip onto a first reinforcement element of the concrete reinforcement structure extending below a desired elevated position of the elevated form panel, the first clip including a first base portion defining a first channel having a threaded surface and a pair of first arm portions each extending from the first base portion to form a cavity between the pair of first arm portions to receive a portion of the first reinforcement element;

a first support rod insertable into the first channel of the first clip, at least a portion of an outer surface of the first support rod being threaded to engage threads on the first clip such that rotation of the first clip with respect to the first support rod in a first rotational direction causes the first clip to move in a first longitudinal direction with respect to the first support rod to move the first arm portions in the first longitudinal direction and rotation of the first clip with respect to the first support rod in a second rotational direction causes the first clip to move in a second longitudinal direction with respect to the first support rod to move the first arm portions in the second longitudinal direction;

a first positioning plate mountable on the first support rod and positionable on the first support rod adjacent to the elevated form panel to support the elevated form panel on the first support rod, the first positioning plate being positioned against the elevated form panel, the first positioning plate having a first passage to receive the first support rod with a threaded surface to engage threads on the first support rod such that rotation of the first positioning plate with respect to the first support rod in the first rotational direction causes the first positioning plate to move in the first longitudinal direction with respect to the first support rod and rotation of the first positioning plate with respect to the first support rod in the second rotational direction causes the first positioning plate to move in the second longitudinal direction with respect to the first support rod, the first positioning plate having a first fastener aperture for receiving a fastener to fasten the first positioning plate to the elevated form panel; and a second positioning subassembly configured to provide positioning of the elevated form panel in a second direction oriented substantially perpendicular to the first direction, the second positioning subassembly comprising:

a second clip configured to removably clip onto a second reinforcement element of the concrete reinforcement structure extending adjacent to the desired elevated position of the elevated form panel, the second clip including a second base portion defining a second channel having a threaded surface and a pair of second arm portions each extending from the second base portion to form a cavity between the pair of second arm portions to receive a portion of the second reinforcement element;

a second support rod insertable into the second channel of the second clip, at least a portion of an outer surface of the second support rod being threaded to engage threads on the second clip such that rotation of the second clip with respect to the second support rod in a first rotational direction causes the second clip to move in a first longitudinal direction with respect to the second support rod to move the second arm portions in a first longitudinal direction and rotation of the second clip with respect to the second support rod in a second rotational direction causes the second clip to move in a second longitudinal direction with respect to the second support rod to move the second arm portions in the second longitudinal direction;

a second positioning plate mountable on the second support rod and positionable on the second support rod adjacent to the elevated form panel to support the elevated form panel on the second support rod, the second positioning plate each being positioned against the elevated form panel, the second positioning plate having a second passage to receive the second support rod with a threaded surface to engage threads on the second support rod such that rotation of the second positioning plate with respect to the second support rod in the first rotational direction causes the second positioning plate to move in the first longitudinal direction with respect to the second support rod and rotation of the second positioning plate with respect to the second support rod in the second rotational direction causes the second positioning plate to move in the second longitudinal direction with respect to the second support rod, the second positioning plate having a second fastener aperture for receiving fastener to fasten the second positioning plate to the elevated form panel.

6. The system of claim 5 wherein the elevated form panel has a pair of opposite broad faces being substantially vertically oriented and a pair of opposite narrow faces being substantially horizontally oriented, the first positioning plate being abutted against one of the narrow faces and the second positioning plate being abutted against one of the broad faces.

7. The system of claim 5 additionally comprising:

a concrete reinforcement structure positioned in the concrete placement space for reinforcing concrete placed in the space, the concrete reinforcement structure comprising:

at least one first reinforcement element oriented in a first horizontal direction;

at least one second reinforcement element oriented in a second horizontal direction, the second horizontal direction being oriented substantially perpendicular to the first horizontal direction;

wherein the first clip of the first positioning subassembly is engaged with the first reinforcement element and the second clip of the second positioning subassembly being engaged with the second reinforcement element.

8. The system of claim 1 wherein the elevated form panel has a pair of opposite broad faces being substantially vertically oriented and a pair of opposite narrow faces being substantially horizontally oriented, the first positioning plate being abutted against one of the narrow face.

9. The system of claim 2 wherein the elevated form panel has a pair of opposite broad faces being substantially vertically oriented and a pair of opposite narrow faces being substantially horizontally oriented, the first positioning plate being abutted against one of the narrow faces and the second positioning plate being abutted against one of the broad faces.

10. The system of claim 1 additionally comprising:

a concrete reinforcement structure positioned in the concrete placement space for reinforcing concrete placed in the space, the concrete reinforcement structure comprising:

at least one first reinforcement element oriented in a first horizontal direction;

at least one second reinforcement element oriented in a second horizontal direction, the second horizontal direction being oriented substantially perpendicular to the first horizontal direction;

wherein the first clip of the first positioning subassembly is engaged with the first reinforcement element.

11. The system of claim 2 additionally comprising:

a concrete reinforcement structure positioned in the concrete placement space for reinforcing concrete placed in the space, the concrete reinforcement structure comprising:

at least one first reinforcement element oriented in a first horizontal direction;

at least one second reinforcement element oriented in a second horizontal direction, the second horizontal direction being oriented substantially perpendicular to the first horizontal direction;

wherein the first clip of the first positioning subassembly is engaged with the first reinforcement element and the second clip of the second positioning subassembly being engaged with the second reinforcement element.

12. A system for forming a cast in place concrete slab, the system comprising:

a concrete form at least partially defining a concrete placement space prepared for receiving the placement of concrete, the space being defined along a lower vertical boundary;

a concrete reinforcement structure positioned in the concrete placement space for reinforcing concrete placed in the space, the concrete reinforcement structure including at least one first reinforcement element oriented in a first horizontal direction;

an elevated form panel configured to form a discontinuity in an upper surface of the cast in place concrete slab; and a form panel positioning apparatus for positioning the elevated form panel in an elevated condition above and in a spaced relationship with the lower vertical boundary of the concrete form defining the concrete placement space with the concrete reinforcement structure in the placement space, the form panel positioning apparatus comprising:

at least one positioning subassembly providing positioning of the elevated form panel in at least one direction, the at least one positioning subassembly including:

a first positioning subassembly configured to provide positioning of the elevated form panel in a substantially vertical direction, the first positioning subassembly comprising:

a first clip removably clipped onto a first reinforcement element of the concrete reinforcement structure extending below a desired elevated position of the elevated form panel, the first clip including a first base portion defining a first channel having a threaded surface and a pair of first arm portions each extending from the first base portion to form a cavity between the pair of first arm portions to receive a portion of the first reinforcement element;

a first support rod insertable into the first channel of the first clip, at least a portion of an outer surface of the first support rod being threaded to engage threads on the first clip such that rotation of the first clip with respect to the first support rod in a first rotational direction causes the first clip to move in a first longitudinal direction with respect to the first support rod to move the first arm portions in the first longitudinal direction and rotation of the first clip with respect to the first support rod in a second rotational direction causes the first clip to move in a second longitudinal direction with respect to the first support rod to move the first arm portions in the second longitudinal direction;

a first positioning plate mountable on the first support rod and positionable on the first support rod adjacent to the elevated form panel to support the elevated form panel on the first support rod, the first positioning plate having a first passage to receive the first support rod with a threaded surface to engage threads on the first support rod such that rotation of the first positioning plate with respect to the first support rod in the first rotational direction causes the first positioning plate to move in the first longitudinal direction with respect to the first support rod and rotation of the first positioning plate with respect to the first support rod in the second rotational direction causes the first positioning plate to move in the second longitudinal direction with respect to the first support rod, the first positioning plate being fastenable to the elevated form panel.

* * * * *